US012590582B2

(12) United States Patent
Danielsson et al.

(10) Patent No.: US 12,590,582 B2
(45) Date of Patent: Mar. 31, 2026

(54) ROTARY PUMP WITH ROTOR BEARING CAP

(71) Applicants: Carl Magnus Danielsson, S.W. Marietta, GA (US); James Richard Howell, Kennesaw, GA (US); James Kyle Lovett, Roswell, GA (US)

(72) Inventors: Carl Magnus Danielsson, S.W. Marietta, GA (US); James Richard Howell, Kennesaw, GA (US); James Kyle Lovett, Roswell, GA (US)

(73) Assignee: Unibloc Hygienic Technologies US, LLC, Chicago, IL (US)

( * ) Notice: Subject to any disclaimer, the term of this patent is extended or adjusted under 35 U.S.C. 154(b) by 106 days.

(21) Appl. No.: 18/443,451

(22) Filed: Feb. 16, 2024

(65) Prior Publication Data

US 2025/0264100 A1 Aug. 21, 2025

(51) Int. Cl.
*F04C 2/08* (2006.01)
*F04C 15/00* (2006.01)

(52) U.S. Cl.
CPC ..... *F04C 2/082* (2013.01); *F04C 15/0057* (2013.01)

(58) Field of Classification Search
CPC ..... F04C 2/082; F04C 2/123; F04C 2/126; F04C 15/0057; F04C 15/0023; F04C 15/0026; F04C 2240/50; F04C 2240/51; F04C 2240/52; F04C 2240/54; F04C 2240/56; F04C 14/265; F01C 21/10; F01C 21/102
See application file for complete search history.

(56) References Cited

U.S. PATENT DOCUMENTS

| | | | | |
|---|---|---|---|---|
| 6,783,342 | B2 * | 8/2004 | Norman | F04C 2/126 418/206.1 |
| 7,905,717 | B2 * | 3/2011 | Whittome | F04C 15/0076 418/206.7 |
| 8,087,914 | B1 * | 1/2012 | Soderstrom | F04C 15/0023 418/132 |
| 9,017,052 | B1 * | 4/2015 | Soderstrom | F04C 2/126 418/206.1 |
| 9,377,021 | B1 * | 6/2016 | Soderstrom | F04C 15/0057 |
| 11,353,019 | B2 * | 6/2022 | Danielsson | F04C 2/126 |
| 2009/0304540 | A1 * | 12/2009 | Whittome | F04C 15/0038 418/104 |
| 2014/0065002 | A1 * | 3/2014 | Garner | F04C 2/126 418/206.1 |
| 2020/0032790 | A1 * | 1/2020 | Garner | F04C 15/0038 |

OTHER PUBLICATIONS

DE102012104736 A1—Moldenhauer—Rotary Pump for Viscous Fluid Medium, Has Heat Exchanger That Is Associated With Temperature Control of Pump Chamber By Heat Carrier, and Is Integrated in Wall of Pump Casing—Dec. 5, 2013—(Year: 2013).*

* cited by examiner

*Primary Examiner* — Essama Omgba
(74) *Attorney, Agent, or Firm* — Miller & Martin PLLC

(57) ABSTRACT

Lobe pumps have bearing discs or caps which can be located at least partially in at least one of cover plates and rotors, if not both to provide at least thrust bearings to space the rotors from the cover plates while facilitating the possibility of clean in place operations. Many embodiments have bearing discs on the rotors which do not restrict axial movement on the shaft, but prevent pumped material from contacting the shaft, and many embodiments have bearing discs friction fit in bearing cutouts and bores (through the rotor and/or cover plate) to facilitate removal when disassembled.

20 Claims, 7 Drawing Sheets

ROTARY PUMP WITH ROTOR BEARING CAP

FIELD OF THE INVENTION

The present invention relates to a rotary pump construction such as a positive displacement pump and more particularly to such pumps potentially having improved rotor constructions and/or improved clean-in-place features over prior art pumps.

BACKGROUND OF THE INVENTION

The applicant is the owner of at least U.S. Pat. Nos. 8,087,914, 9,017,052, and 9,377,021 for improved positive displacement pumps with rotors. These pumps lock the rotors to the shafts. These designs have been well received in the marketplace. U.S. Pat. No. 11,353,019 is a recent design of the applicant which works well, and is likely the closest prior art, but this design does not axially secure rotors to the shafts along the shaft axes.

While these designs have rotor pads on the faces that face the cover (and opposing side) in an effort to reduce wear on the rotors themselves, they do not specifically address sealing shafts from pumped material except, possibly, for the rotor bolts 44,46 shown in FIG. 1 of U.S. Pat. Nos. 8,087,914, 9,017,052 and 9,377,021.

These prior art rotor bolts extend into the shafts to prevent axial mount of the shafts (col 3, lines 37-45). Furthermore, the covers on these designs are typically secured with nuts such as nut 20 in U.S. Pat. No. 9,937,021 requiring a wrench for installation/removal. U.S. Pat. No. 11,353,019 shows embodiments often requiring screwdriver blade notches 170,172, etc. to remove bearing rings where the material being pumped may accumulate in addition to around the splines of the rotors in an undesirable manner which would require the pump to be disassembled to be cleaned thoroughly.

In the field of food service, many pumps are regularly disassembled and cleaned. In order to accomplish this, tools are often required. Even U.S. Pat. No. 11,353,019 requires removing the bearing rings for cleaning the pump.

An improved clean in place design pump is believed to be desirable for many customers.

SUMMARY OF THE INVENTION

It is an object of many embodiments of the present invention provide an improved rotary pump with improved sealing characteristics.

It is another object of many embodiments to provide an improved rotary pump which can have a rotor having a cap sealing the splines from contact with material pumped while possibly permitting axial movement mount of the rotors relative to the shafts for at least some embodiments.

It is another object of many embodiments of the present invention to have an improved positive rotary pump having improved clean in place capability.

It is another object of many embodiments of the present invention to locate bearing discs in cutouts in at least one of a cover and a rotor for use in at least one of providing a thrust bearing, providing a sealing surface and/or providing a radial bearing.

Accordingly, in accordance with a presently preferred embodiment of the present invention, a rotary pump is providing having a rotor housing defining a cavity intermediate side walls, an end wall and a cover plate. An inlet and outlet communicate with the cavity. Parallel first and second shafts extend into the cavity from the end wall which rotate first and second rotors to provide pumping action (to direct fluid/material from the inlet to out the outlet).

Bearing discs could be installed at least partially into the cover and/or on the rotors themselves such as in a bearing cutout extending into at least one of the covers and/or the rotors of the various embodiments, preferably without connecting directly to the shafts. Bearing discs may also extend at least partially outwardly from the bearing cutouts. Additionally, first bearing discs may be located at/in the cover while second bearing discs may be disposed at/in the rotors with the first and second bearing discs contacting one another in the cavity, when both are utilized.

In accordance with the presently preferred embodiment of the present invention, a positive displacement pump, also known as a rotor pump, having parallel shafts with rotors thereon receive an input (at input) and then expel an output (an output) based on the rotation of the rotors has improvements over prior art constructions. Specifically, the rotors may have ears extending from a hub which is received on a shaft. For many embodiments, the hub or other structure often extends the full length of the rotors on the shaft. Each of the hubs preferably provide an internal a cutout having a shelf at an end of the rotor radially external to a bore diameter receiving the shaft therein whereby a bearing disc is received, and possibly sealed, at least partially into the cutout, preferably against the shelf thereby preventing pumped material from contacting the shafts internal to the rotors. The shafts are preferably spaced from and not directly secured to the bearing discs like rotor bolts of prior art designs.

When disassembling the pump, the rotors may be slid rearwardly off the shaft with the cover plate removed and a tool or other device may be pushed through the front of the rotors to push the bearing caps off of the rear of the rotors.

Some embodiments may have planar rear cover plates which may potentially receive bearing discs in disc cutouts in the rear cover plate, preferably in a friction fit construction (preferably no notches like 170 in U.S. Pat. No. 11,353,019 exist about the discs for many embodiments). These discs may be connected to the cover plate with bolts extending through the cover plate into the bearing discs or otherwise if not solely friction fit into the cutouts. When the bolts are removed (if present), bores remaining through the cover plate, if present, may have a tool directed therethrough to assist in removing the bearing discs from the rear cover plate.

BRIEF DESCRIPTION OF THE DRAWINGS

The accompanying drawings illustrate the preferred embodiments of the invention and, together with the description, serve to explain the invention. These drawings are offered by way of illustration and not by way of limitation.

DETAILED DESCRIPTION OF THE PREFERRED EMBODIMENT

Figure 1:
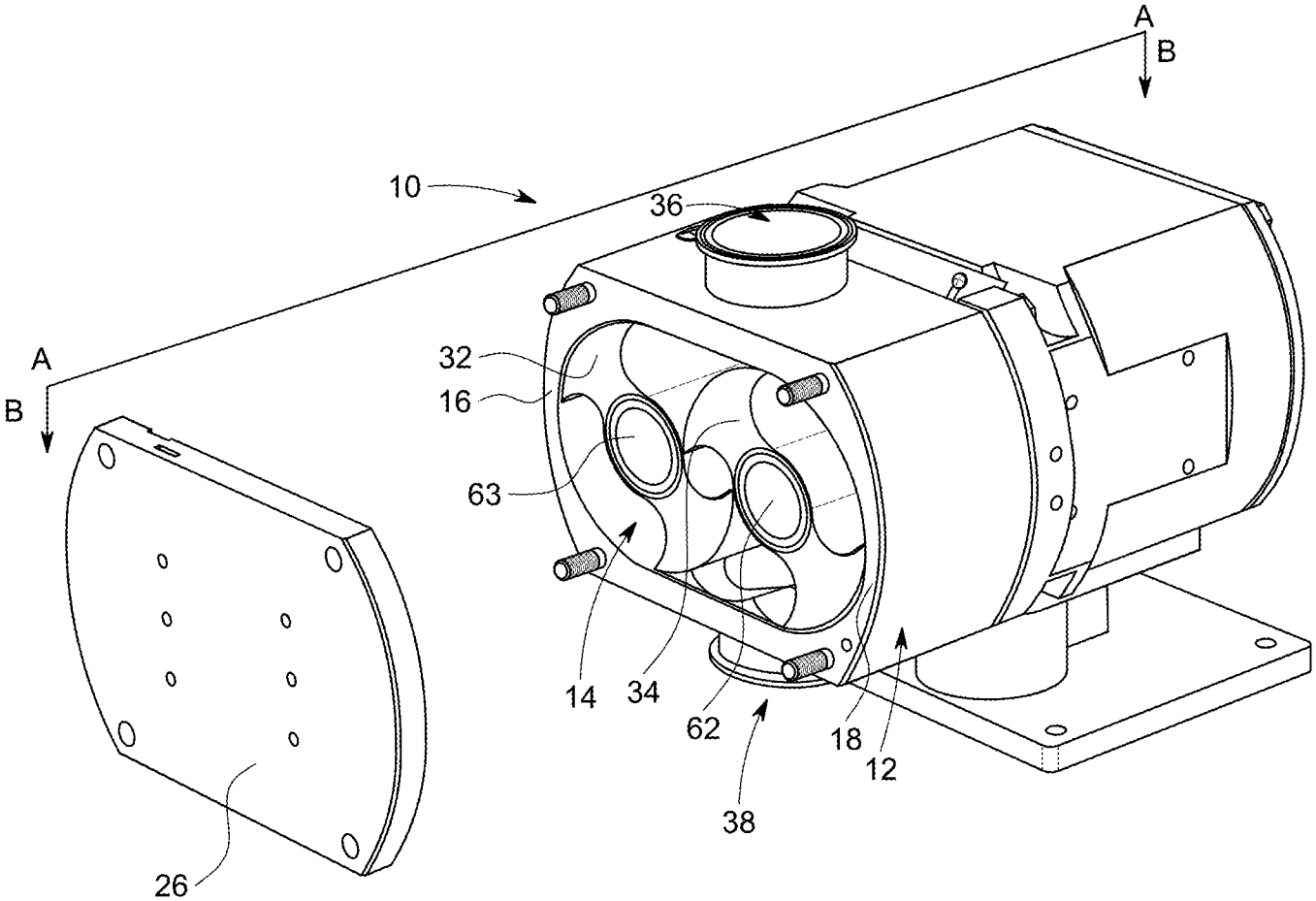
FIG. 1 is a front perspective partially exploded view of the presently preferred embodiment of the present invention.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term module refers to a part of, or includes an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. In the example of a processor executing code, the term module includes memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

Figure 2:
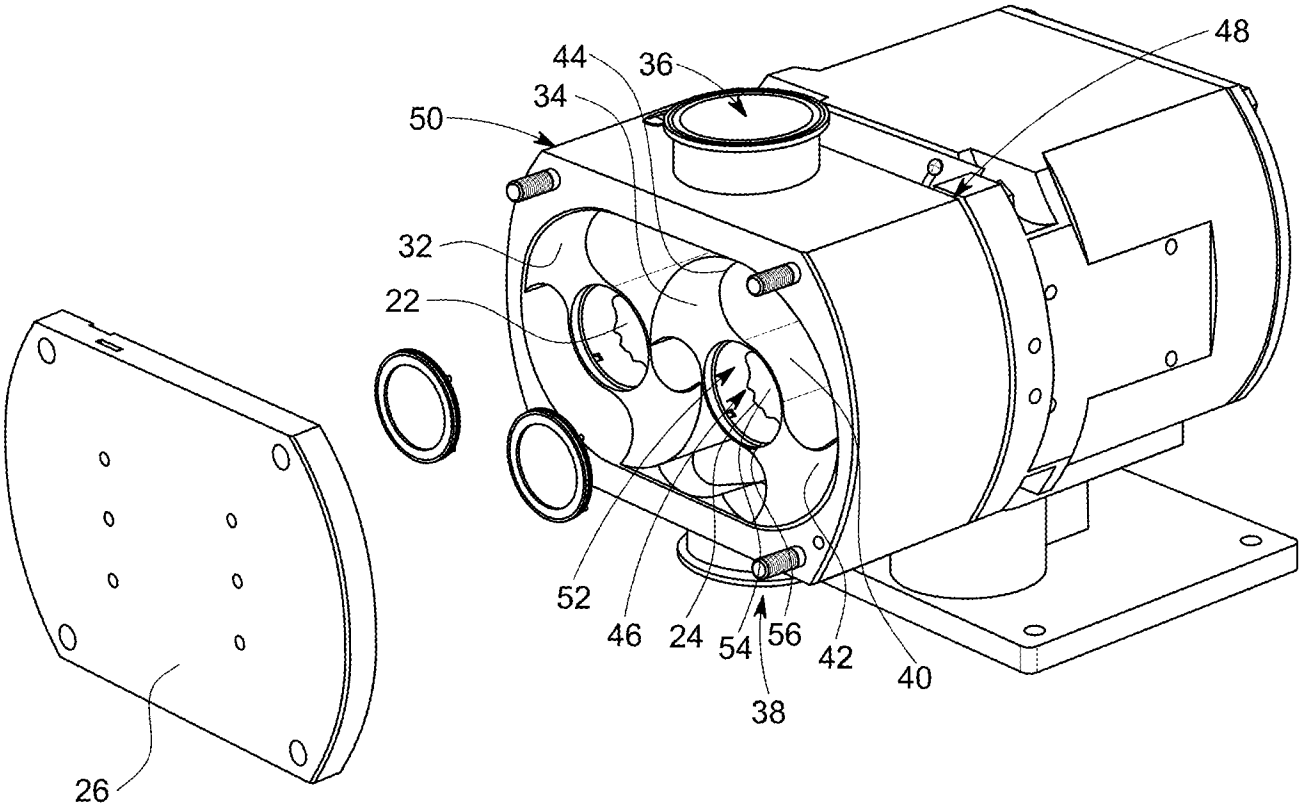
FIG. 2 is a front perspective partially exploded view of the present invention as shown in FIG. 1 with the bearing discs removed from the rotors.
Figure 3:
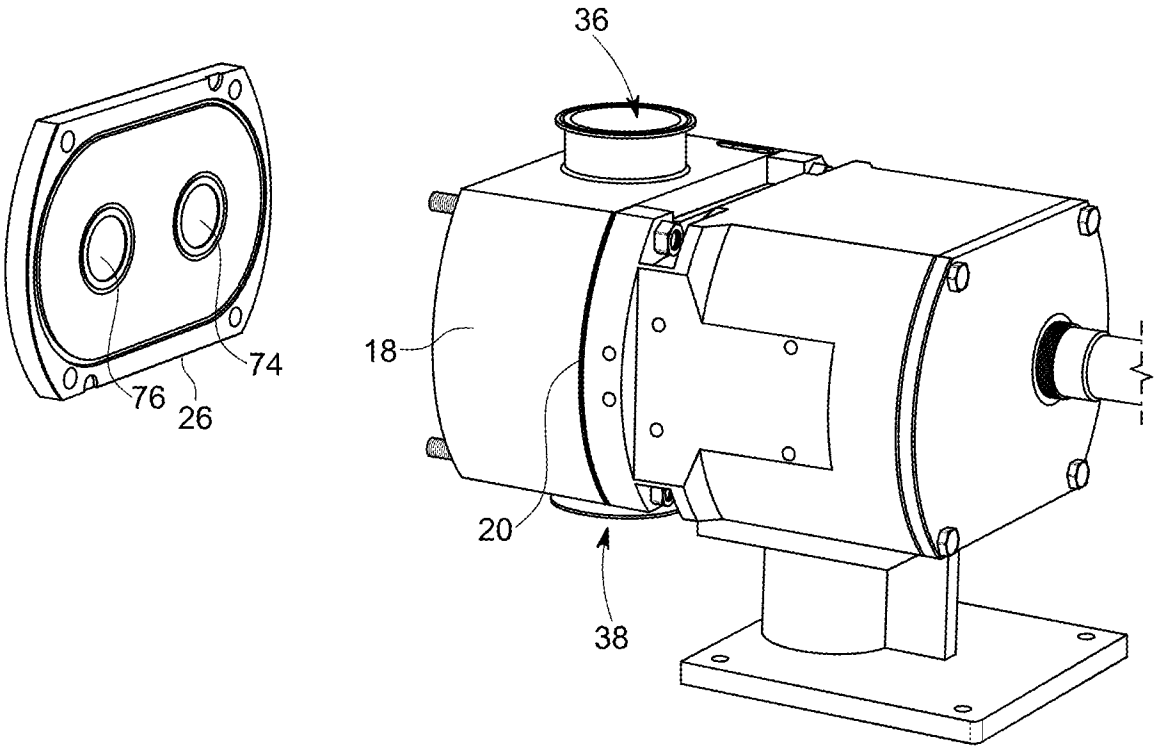
FIG. 3 is a rear perspective partially exploded view of the present invention shown in FIGS. 1-2.
Figure 4:
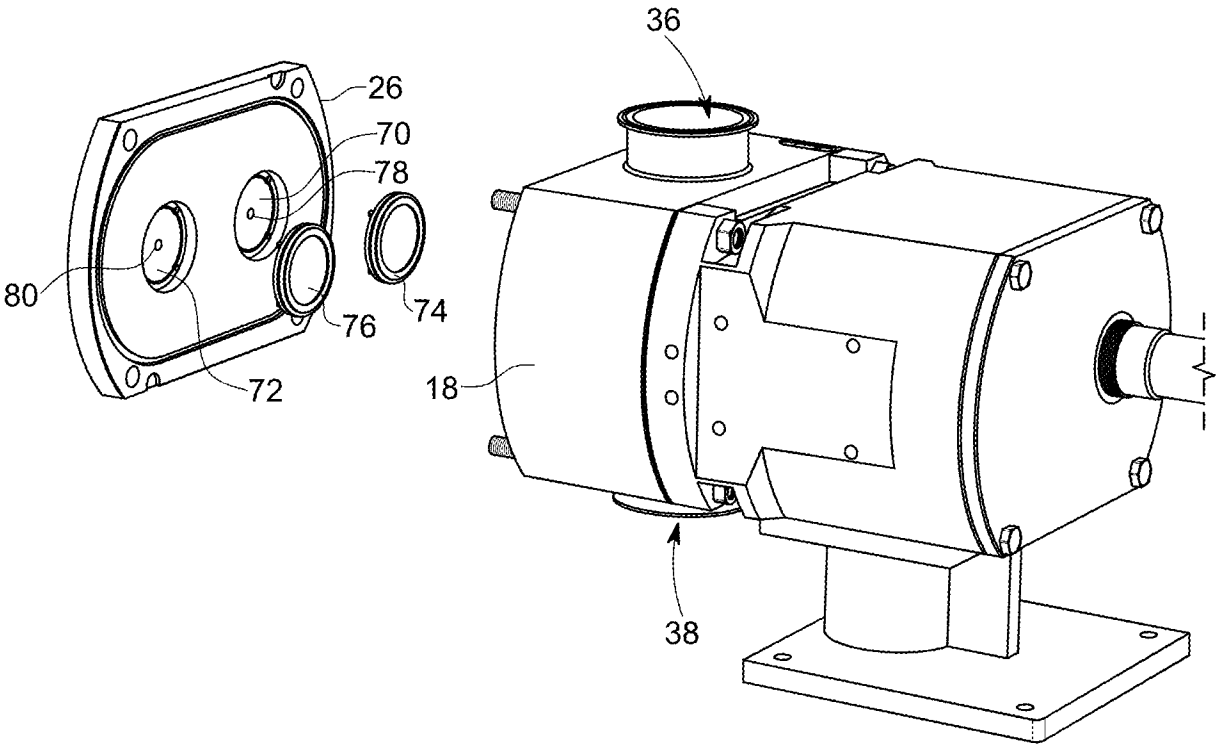
FIG. 4 is a rear perspective partially exploded view of the present invention as shown in FIGS. 1-3 with the bearing discs removed from the rear cover.
Figure 5:
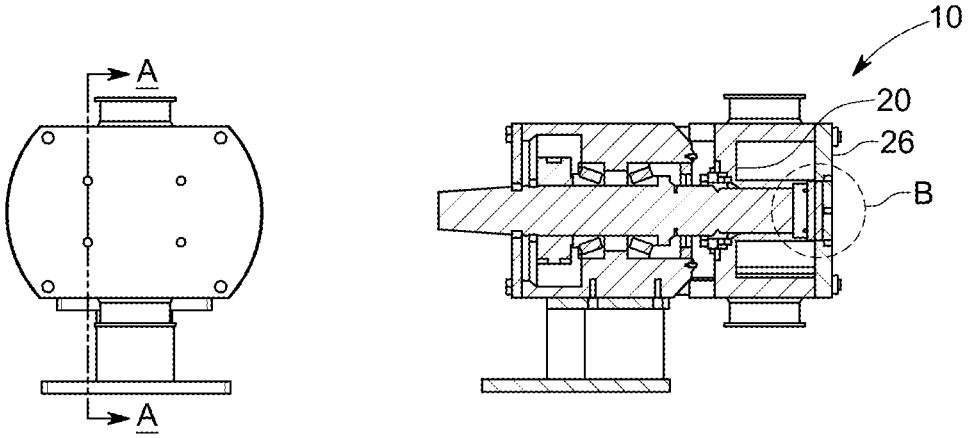
FIG. 5 is a schematic cutaway view of an assembled pump of FIGS. 1-4.
Figure 6:
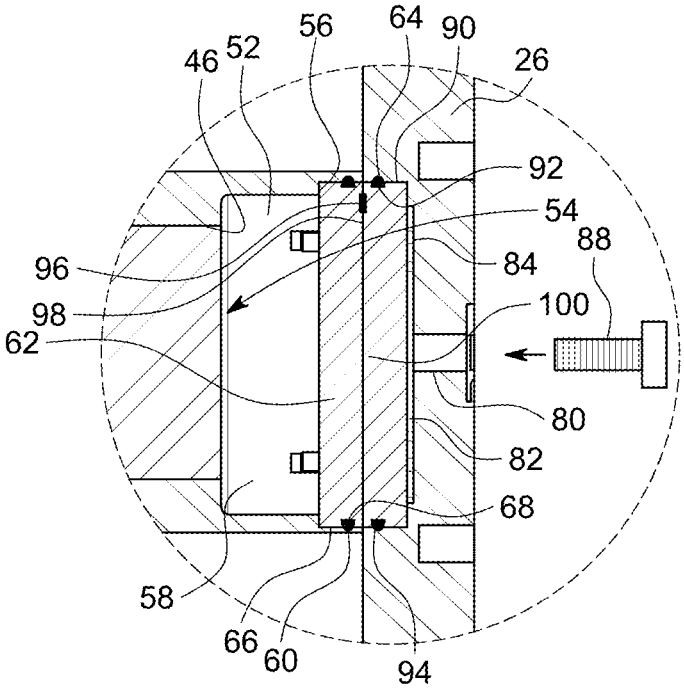
FIG. 6 is a schematic cutaway view showing Detail B in FIG. 5.
Figure 7:
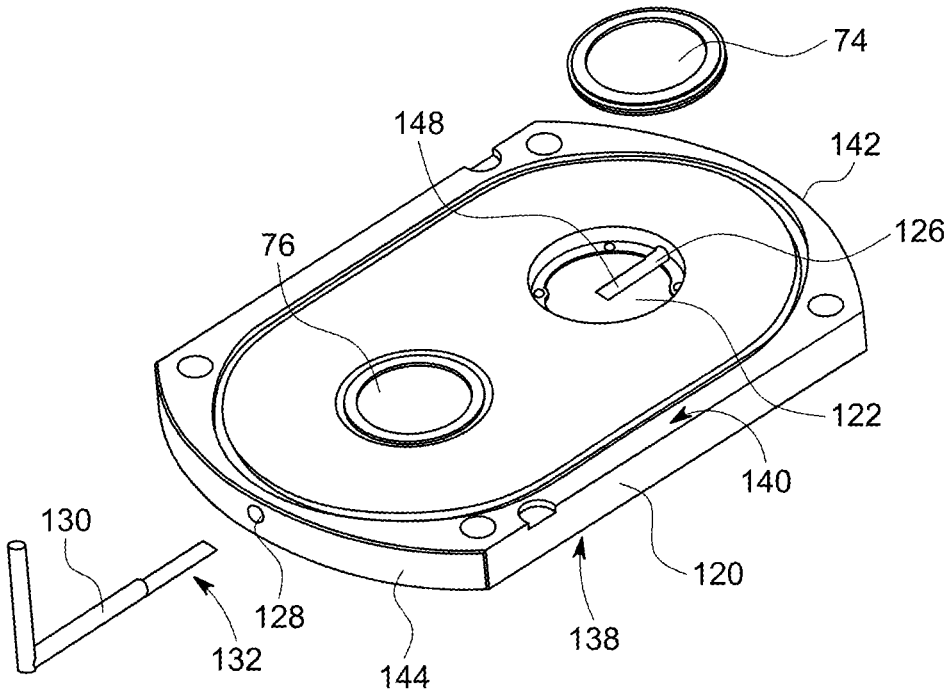
FIG. 7 is a rear perspective view of a first alternatively preferred cover plate removed from the pump.
Figure 8:
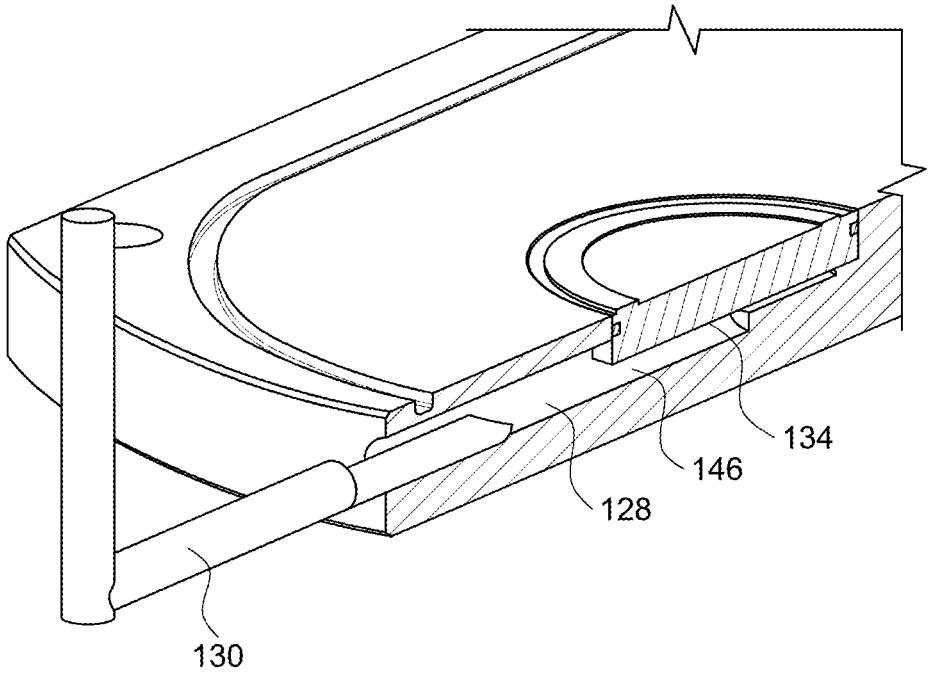
FIG. 8 is a rear perspective view of the cover plate of FIG. 7 with a key partially inserted therein.

The figures show a rotary lobe pump 10 having a rotor housing 12 defining a cavity 14 shown on FIG. 2 intermediate side walls 16 and 18, an end wall 20 and a cover plate 26. Into the cavity 14 from the end wall preferably extends first and second shafts 22, 24 which are parallel shafts. The cover plate 26 is preferably located opposite the end wall 20 and will be discussed below. The pump 10 further comprises an inlet 36 and an outlet 38 (or vice versa) which may extend through the side walls 16, 18 and/or other portion of the pump housing 12. Mounted on the first and second shafts 22, 24 are preferably first and second rotors 32 and 34 provided as a pair of rotors 32,34. Rotors 32 and 34 are shown as having splined hubs 40 as will be explained in further detail below which can cooperate with splined exterior surfaces of the first and second shafts 22, 24 as would be understood by those of ordinarily skill in the art for at least some embodiments, but for all embodiments, it is envisioned that there is a hub cavity 52 internal to the rotors 36,38 as explained in further detail below. Other methods of connecting the rotors 32,34 to shafts 22, 24 could be employed with still other embodiments.

The rotors 32,34 preferably have hubs 40 connected to ears 42,44. The hubs 40 have a central bore 46, which receives the appropriate shaft 22, 24 therein. The shafts 22,24 extend from a front 48 toward a rear 50 of the pump housing 12 when installed. However, the shafts 22,24 do not extend completely to the rear 50 of the pump housing 12, but instead leave a hub cavity 52 spacing an end 54 of the shaft 22,24 from the rear 50 of the pump housing 12. A rotor bolt does not extend into the shafts 22,24 holding the rotors to the shafts 22,24. The hub cavity 52 preferably has a shelf 56 located radially externally of the central bore 46 receiving the shaft 22,24. The shafts 22,24 are spaced from rear 50 of the pump housing 12 providing a larger diameter than the central bore 46 at that portion than the central bore 46 receiving the shaft 22,24.

A seal 58 may be received in the hub cavity 52 which may or may not assist in retaining a bearing disc 62 with the bearing disc 62 received in a bearing disc cutout 64 at least partially defined by the shelf 56. Seal 58 does not secure to the shafts 22,24 and may be spaced apart therefrom as illustrated or otherwise.

Bearing disc 62 may have an o-ring 60 on a circumferential surface 66 against the bearing disc cutout 64, possibly at least partially disposed in a groove 68 on the side surface 66 of the bearing disc 62. With such a construction the hub cavity 52 is sealed so that material being pumped by the pump 10 cannot contact the splines or other portions of shaft 22 or 24 so that as it relates to internal portions of the rotors 32,34, the pump 10 can be cleaned in place without disassembly for many pumped goods. For many embodiments, the rotors 32,34 are free to move axially relative to the shafts 22,24.

The cover plate 26 may have bearing disc cutouts 70,72 which receive bearing discs 74,76, often in a friction fit when installed. A shelf 84 may assist in defining the bearing disc cutouts 70,72 which may leave a cavity 82 possibly communicating with a bore 78 and 80 through which bolts 88 may extend through, possibly into bearing disc 74 or 76. With the bolt 88 removed a tool may be directed through bore 80 (or 78) when the cover plate 26 is removed from the pump 10 so as to push the bearing discs off of the cover plate 26 for replacement purposes. Bearing discs 74,76 preferably have side surfaces 90 which may have channels 92 receiving o-rings 94 to assist in sealing and/or the friction fit, or not. With the friction fit, no pumped material can lodge in the cover plate 26 as can occur in the notches 170, etc. of U.S. Pat. No. 11,353,019.

Opposing surfaces 96,98 of each of the bearing discs 62 and 76 and 63 and 74, respectively may possibly contact one another, possibly while leaving gap 100 therebetween, or not, for various embodiments.

Bearing discs 62,63 are preferably completely spaced apart from the shafts and not directly secured thereto as a rotor bolt would be in the prior art.

An alternatively preferred embodiment is shown in FIGS. 7-10 for the bearing cap or bearing discs 74,76 located relative to a cover plate 120. Disc cutouts 122,124 can receive the bearing discs 74,76 somewhat similarly as disc cutouts 70,72 of the previously discussed embodiment. These disc cutouts may accommodate lateral bores 126,128, which may receive a key 130 or other tool, at least partially therein and therethrough as will be explained in further detail below.

Figure 9:
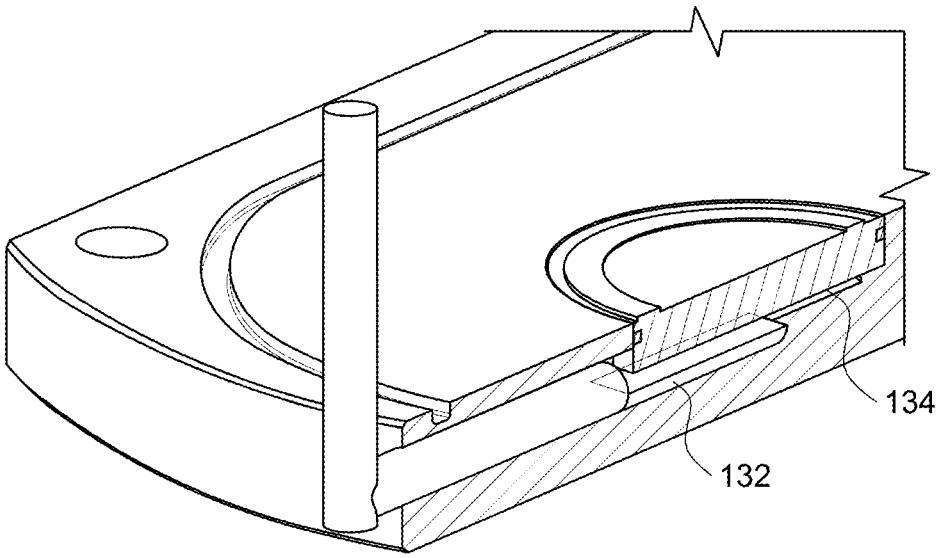
FIG. 9 is a rear perspective view of the cover plate of FIG. 7 with a key fully inserted therein.
Figure 10:
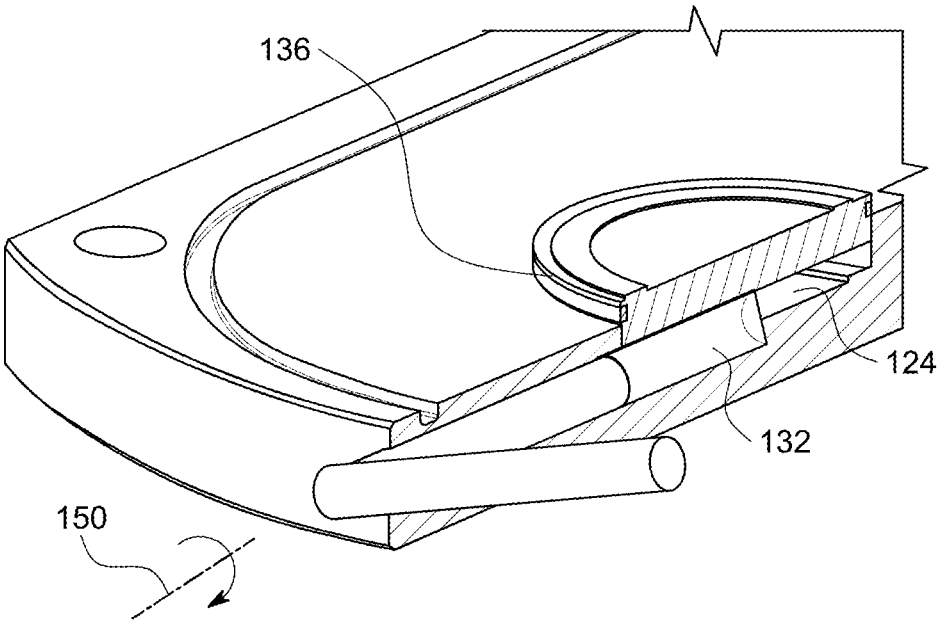
FIG. 10 is a rear perspective view of the cover plate of FIG. 7 with a key fully inserted therein and twisted to assist in removing the bearing cap in the cover plate.

Key 130 may have an operator 132 which may be inserted through the lateral bores, and preferably behind a rear surface 134 of the bearing discs. Operator 132 may be semi-circular for at least some embodiments, such as approximately half the diameter of the lateral bores 126,128 (or slightly less), so that when inserted, a top surface of the operator 132 does not contact the rear surface of the bearing discs 74,76. Once fully inserted as shown in FIG. 9, the key 130 may be twisted, such as along bore axis 150, so that the operator contacts the rear surface 134 of the bearing disc 74,76 and outwardly directs the bearing disc 74,76 from the affected disc cutout 122,124 at least sufficiently so that the bearing disc 74,76 may be handled from sides 136 to continue the removal process, if necessary.

With this construction, the lateral bores 126,128 may not possibly permit fluid to pass completely through from front 138 to rear 140 of cover plate 120 like the other embodiment discussed above, such as if either of the bearing discs 74,76 were to fail. Lateral bores 126,128 communicate the disc cutouts 122,124 with side surfaces 142,144, respectively of the cover plate 120.

Lateral bores 126,128 communicate with slots 146, 148 which are at the bottom of disc cutouts 122,124. Slots preferably have a height of about the height of a radius of the bores 126,128 which is slightly greater than a height of the operator 132 of the key 130 when inserted into the slots 146,148. Once the key 130 turns about axis 150 the operator elevates at least partially out of the slot 146,148 to at least partially dislodge the bearing disc(s) 74,76 from the affected disc cutout(s) 122,124.

Numerous alterations to the structures herein disclosed will suggest themselves to those skilled in the art. However, it is to be understood that the present disclosure relates to the preferred embodiment of the invention for which is for purposes of illustration only and not to be construed as a limitation of the invention. All such modifications which do not depart from the spirit of the invention are intended to be included within the scope of the appending claims.

What is claimed is:

1. A rotary lobe pump comprising:

a rotor housing assisting defining a pump cavity intermediate side walls, an end wall and a cover plate;

parallel first and second shafts extend into the cavity from the end wall;

an inlet port and an outlet port communicating with the cavity;

first and second rotors connected to the first and second shafts, respectively; each of the first and second rotors having ears with faces directed toward the cover plate connected respectively to central hubs with the hubs connected to the respective first and second shafts, and hub cavities extending respectively from ends of the first and second shafts to ends of the hubs; and first bearing discs located at least partially in the hub cavities sealing off the hub cavities from the pump cavity from fluid communication while the first bearing discs do not restrict axial movement of the first and second rotors along axes of rotation of the first and second shafts.

2. The rotary lobe pump of claim 1 further comprising bearing disc cutouts extending into the ends of the hub, said bearing disc cutouts have a larger diameter than a bore through the hubs receiving the first and second shafts, respectively.

3. The rotary lobe pump of claim 2 further comprising a seal located in the hub cavity between the first bearing discs and the ends of the first and second shafts, respectively.

4. The rotary lobe pump of claim 3 further comprising second bearing discs located at least partially in the cover plate colinearly disposed relative to the axes of rotation of the first and second shafts.

5. The rotary lobe pump of claim 4 wherein the second bearing discs are at least partially located within bearing disc cutouts in the cover plate.

6. The rotary lobe pump of claim 5 wherein the second bearing discs are friction fit within bearing disc cutouts in the cover plate and further comprising bores extending through the cover plate internal to a perimeter of the second bearing discs whereby an a key is directed through the bores to push the second bearing discs out of the bearing disc cutouts to overcome the friction fit when the cover plate is removed from the pump.

7. The rotary lobe pump of claim 2 wherein the bearing disc cutouts in the rotors are at least partially defined by a shelf and the first bearing discs contact the shelf when installed.

8. The rotary lobe pump of claim 7 wherein the first bearing discs are friction fit within the bearing disc cutouts.

9. The rotary lobe pump of claim 7 wherein each first bearing disc has a sidewall with a groove therein and an O-ring is positioned within each groove.

10. The rotary lobe pump of claim 1 further comprising second bearing discs located at least partially in the cover plate colinearly disposed relative to the axes of rotation of the first and second shafts.

11. The rotary lobe pump of claim 10 wherein the second bearing discs are at least partially located within bearing disc cutouts in the cover plate.

12. The rotary lobe pump of claim 11 wherein the second bearing discs are friction fit within bearing disc cutouts in the cover plate and further comprising bores extending through the cover plate internal to a perimeter of the second bearing discs whereby an a key is directed through the bores to push the second bearing discs out of the bearing disc cutouts to overcome the friction fit when the cover plate is removed from the pump.

13. The rotary lobe pump of claim 12 wherein each second bearing disc has a sidewall with a groove therein and an O-ring is positioned within each groove.

14. The rotary lobe pump of claim 10 further comprising a central cavity located at least partially between the first and second bearing discs.

15. A rotary lobe pump comprising:

a rotor housing assisting defining a pump cavity intermediate side walls, an end wall and a cover plate;

parallel first and second shafts extend into the pump cavity from the end wall;

an inlet port and an outlet port communicating with the cavity;

first and second rotors connected to the first and second shafts, respectively; each of the first and second rotors having ears with faces directed toward the cover plate connected to a central hub with; and second bearing discs are at least partially located within bearing disc cutouts in the cover plate, said second bearing discs friction fit within bearing disc cutouts in the cover plate and further comprising bores extending through the cover plate internal to a perimeter of the second bearing discs whereby a key is directed through the bores to push the second bearing discs out of the bearing disc cutouts to overcome the friction fit when the cover plate is removed from the pump.

16. The rotary lobe pump of claim 15 further comprising a hub cavities extending respectively from ends of the first and second shafts to ends of the hubs, and first bearing discs located at least partially in the hub cavities sealing off the hub cavities from the pump cavity from fluid communication while the first bearing discs do not restrict axial movement of the first and second rotors along axes of rotation of the first and second shafts.

17. The rotary lobe pump of claim 16 further comprising bearing disc cutouts extending into the ends of the hubs, said bearing disc cutouts have a larger diameter than a central bore through the hubs receiving the first and second shafts, respectively.

18. The rotary lobe pump of claim 17 further comprising a seal located in each hub cavity between the first bearing discs and the ends of the first and second shafts, respectively.

19. The rotary lobe pump of claim 18 wherein the first bearing discs are friction fit within the bearing disc cutouts.

20. The rotary lobe pump of claim 19 wherein each first bearing disc has a sidewall with a groove therein and an O-ring is positioned within each groove.

* * * * *